United States Patent [19]

Foster et al.

[11] 4,371,099

[45] Feb. 1, 1983

[54] SIZE-COMPENSATING COLLAR IN A PUMP DISPENSER

[75] Inventors: Donald D. Foster, Kingsville, Mo.; Wallace F. Magers, Leawood, Kans.

[73] Assignee: Realex Corporation, Kansas City, Mo.

[21] Appl. No.: 207,891

[22] Filed: Nov. 18, 1980

[51] Int. Cl.[3] ..... B67D 5/42

[52] U.S. Cl. ..... 222/321; 222/385; 222/153

[58] Field of Search ..... 222/309, 321, 383, 385, 222/362, 288, 153; 215/330; 267/161, 162

[56] References Cited

U.S. PATENT DOCUMENTS

| | | | |
|---|---|---|---|
| 1,961,438 | 6/1934 | Winter | 267/161 |
| 3,248,021 | 4/1966 | Corsette et al. | 222/385 |
| 3,359,917 | 12/1967 | Cooprider | 222/321 |
| 3,458,090 | 7/1969 | Scoggin | 222/385 |
| 3,531,224 | 9/1970 | Clevenger et al. | 222/321 |
| 4,065,038 | 12/1977 | Magers et al. | 222/321 |

*Primary Examiner*—H. Grant Skaggs

*Attorney, Agent, or Firm*—Schmidt, Johnson, Hovey & Williams

[57] ABSTRACT

The collar of the pump clamps the top wall of a closure against an underlying, external flange on the pump body, and although the collar is always a fixed, predetermined distance from the flange, a variety of closures with differing top wall thicknesses may be accommodated by the collar because of the yieldable nature of an integrally depending element at a lower periphery of the collar that makes the actual clamping engagement of the collar with the closure. Such element may be defined by an annular series of separate, deflectable segments around the periphery of the collar or by a continuous annular surface capable of deflecting away from the lip but maintaining forcible engagement with the top wall of the closure at all times.

7 Claims, 9 Drawing Figures

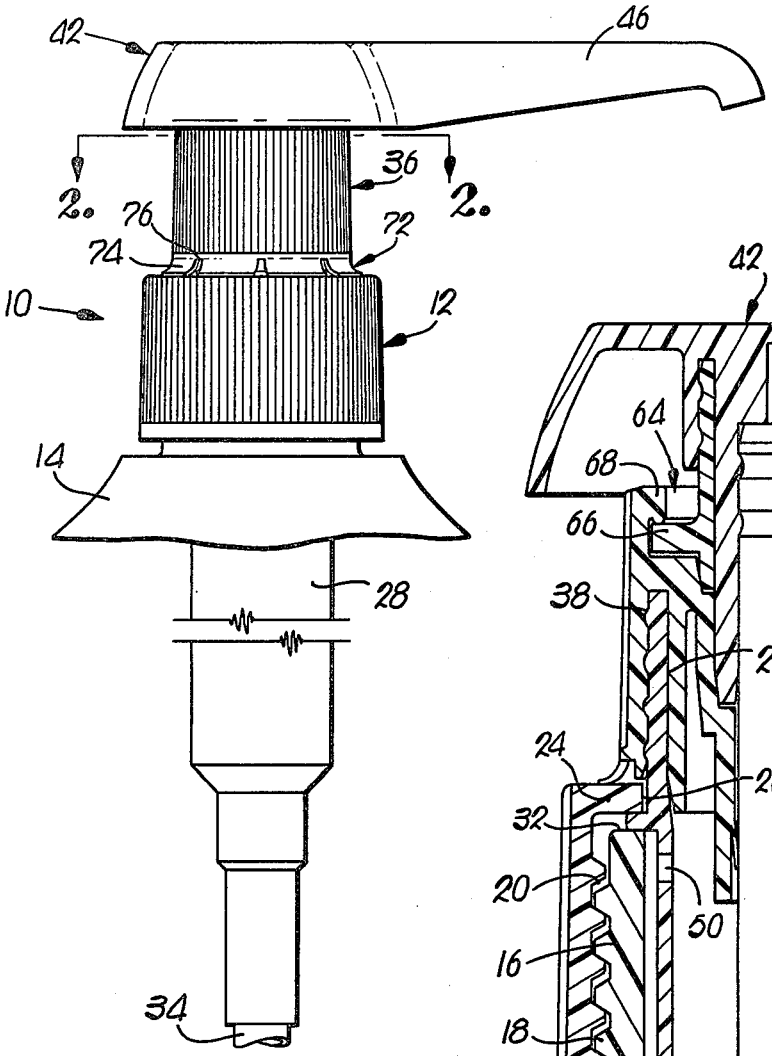
Fig. 1.
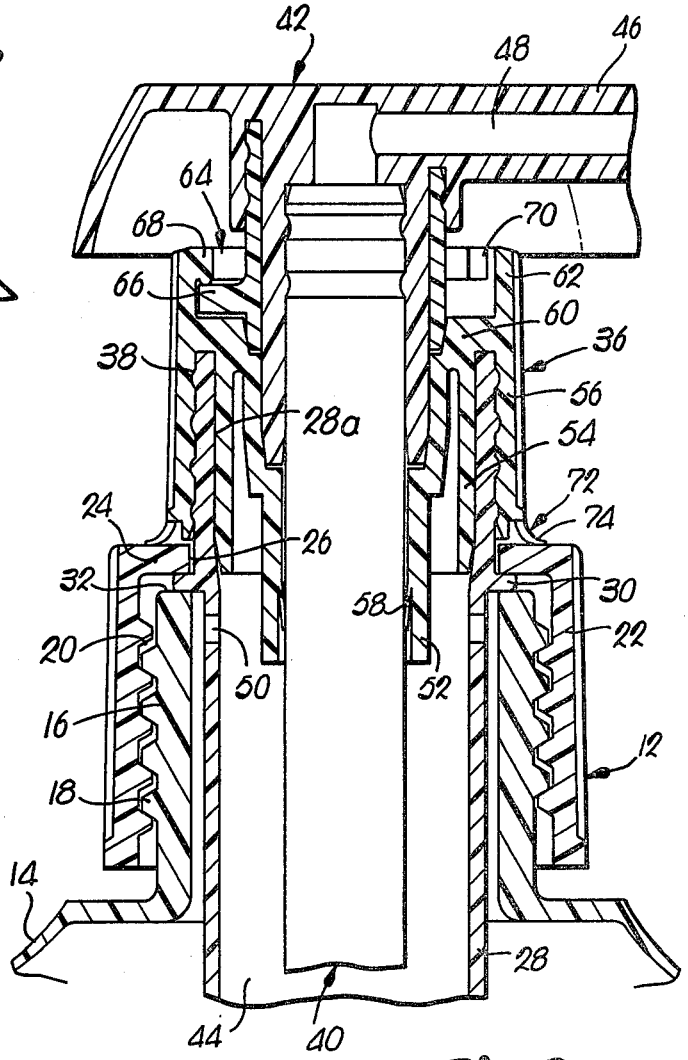
Fig. 3.
Fig. 2.
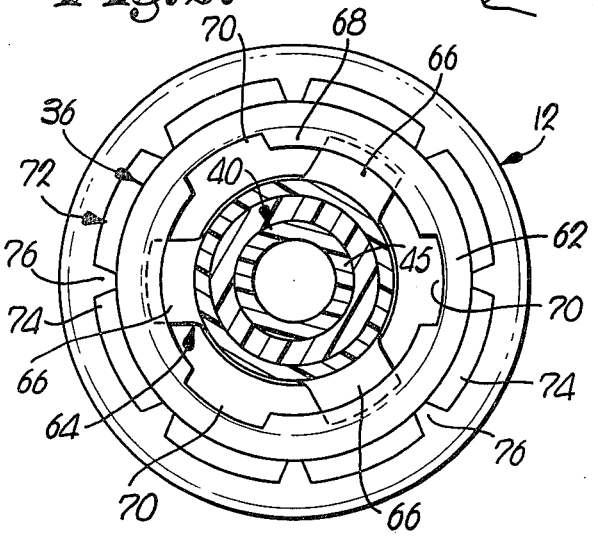
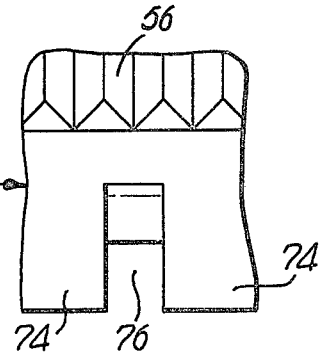
Fig. 4.

SIZE-COMPENSATING COLLAR IN A PUMP DISPENSER

TECHNICAL FIELD

This invention relates to the field of hand-operated pumps and, more particularly, to a special collar construction for use in connection with such pumps.

BACKGROUND ART

The use of a collar to attach the pump to a selected closure is a well known expedient in the art. Typically, such collars clamp the top wall of the closure between the lower periphery of the collar on the one hand and an external flange of the pump body on the other hand. Thus, the pump and closure form a complete assembly that can be threaded onto the neck finish of the particular container with which the pump is to be utilized.

Closures are available in a myriad of sizes, shapes and wall thicknesses. Yet it is desirable that one pump fit all varieties. Since the collar of the pump is designed to remain a standard distance from the flange of the pump body for all closures, regardless of their wall thickness, it becomes essential to have some way of accommodating the additional space required by some closures without sacrificing a tight fit on those closures of lesser thickness. Thus, in pumps such as shown in Clevenger et al. U.S. Pat. No. 3,500,761 "Control Valve for Hand Pumps" owned by the assignee of the present invention, there is a yielding or flexing of the collar in some weakened area thereof when the collar is clamped against a greater than normally thick closure with which the pump is associated. A relatively thin web 64 of the collar 16 on the pump in the aforesaid patent provides the necessary flexure.

In some instances, however, flexure in that area cannot be tolerated. For example, in pumps having plungers that can be locked in the "down" position for shipment or storage, the relationship and fit of interengageable locking components of the collar and the plunger can be quite critical to successful operation. Thus, it is essential that no flexure and relative movement of the locking components of the collar occur relative to the cooperating components of the plunger. Rather, both sets of components need to be substantially isolated from the give-and-take of the collar as it compensates and accommodates for the various thicknesses of closures on which the pump is installed.

SUMMARY OF THE PRESENT INVENTION

Accordingly, one important object of the present invention is to provide a collar which will localize the flexure and yielding of the collar for accommodating closure thickness variations in an area of the collar where such compensating action will not adversely affect other important functions of the collar, including, for example, serving as one part of a down position lock for the plunger, providing a bearing surface for the reciprocable plunger, and effecting a seal against accidental escape of contents from the container. To this end, the present invention provides a yieldably resilient element depending from and integral with the lower periphery of the collar in position to exert clamping pressure against the upper surface of the closure top wall in opposition to the flange against the underside of the top wall. The clamping element is considerably more yieldable than the outer skirt of the collar from which it depends such that the necessary yielding action of the collar takes place in the special element instead of in the skirt itself or in components of the down position lock that may be associated with the collar adjacent the skirt. Preferably, the element takes the form of a discontinuous, annular series of segments that flex outwardly and upwardly away from the flange to the extent necessary to accommodate the particular thickness of the selected closure. In the alternative, the element may take the form of a continuous, non-segmented, annular extremity of the collar yieldable upwardly and outwardly under clamping pressure of the collar against the closure.

BRIEF DESCRIPTION OF THE DRAWINGS

FIG. 1 is a fragmentary side elevational view of a pump installed on the closure of a container and utilizing a collar constructed in accordance with the principles of the present invention;

FIG. 2 is an enlarged, horizontal cross-sectional view of the pump taken substantially along line 2—2 of FIG. 1;

FIG. 3 is an enlarged, fragmentary vertical cross-sectional view of the pump, closure and container;

FIG. 4 is an enlarged, fragmentary elevational view of the lower extremity of the collar illustrating the segmented nature of the clamping element thereof;

DETAILED DESCRIPTION

Figure 5:
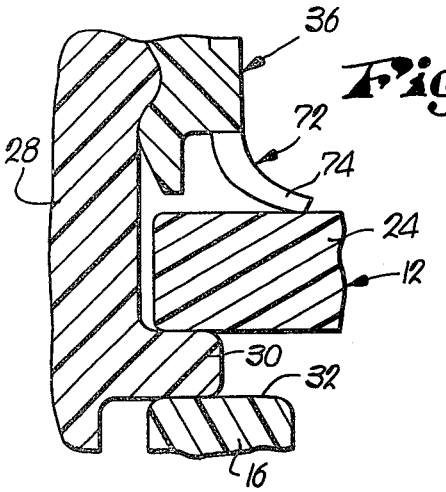
FIGS. 5 and 6 are enlarged, fragmentary vertical cross-sectional views of the installed pump showing the way in which the clamping element thereof accommodates closures of different wall thicknesses.

The pump 10 of FIGS. 1–6 is illustrated installed upon the closure 12 of a container 14 having a neck finish 16. The neck finish 16 has external threads 18 which mate with internal threads 20 of the closure 12 formed on the annular sidewall 22 thereof. The top wall 24 of the closure 12 is provided with a centrally disposed opening 26 through which the tubular body 28 of the pump 10 projects. An external, annular flange 30 on the body 28 rests upon the top edge 32 of the neck finish 16 in order to suspend the lower portion of the body 28 and the dip tube 34 down into the interior of the container 14.

In addition to the body 28, the pump 10 further includes an annular collar 36 snapped onto the upper end of the body 28 via interfitting beads and grooves denoted broadly by the numeral 38. The collar 36 serves to attach the pump 10 to the closure 12 such that the latter and the pump 10 together form an assembly which can be threaded onto and off of the container 14 as desired.

The collar 36 is located in axial registration with the body 28 and functions further to provide a bearing surface for the reciprocable plunger 40 of the pump 10 having an operating head 42 at its upper end which may be maually depressed and raised in order to reciprocate the plunger 40 and operate the pump 10. As is well understood by those skilled in the art but not shown herein, the pump 10 also includes a piston seal on the lower end of the plunger 40 and suitable valve means operable to draw liquid from the container 14 into the chamber 44 of body 28 when the plunger 40 is raised by the head 42 and to cause such liquid within the chamber 44 to thereafter be forced upwardly through an internal passage 45 (FIG. 2) of the plunger 40 upon the latter's depression and out the spout 46 of head 42 via outlet 48. Suitable vent holes 50 in the body 28 slightly below the flange 30 allow the ingress of ambient air into the container 14 from along the interface between the plunger 40 and the collar 36 for the purpose of equalizing the pressure externally and internally of the container 14 during raising of the plunger 40.

The collar 36 is provided with a series of three, depending, annular skirts 52, 54 and 56 concentrically disposed with respect to one another and with the plunger 40 and the body 28. The innermost skirt 52 is of the least diameter and provides a bearing surface 58 for the plunger 40. The intermediate skirt 54 is shorter than the skirt 52 but has a greater diameter and fits tightly along the upper interior surface 28*a* of the body 28 in sealing engagement therewith. The outer skirt 56 is the shortest of the three but is of the greatest diameter and encircles the upper portion of the body 28 about the exterior thereof. It is the internal surface of the skirt 56 which interfits with the external surface of the upper end of the body 28 via the beads and grooves 38.

An annular, transverse web 60 adjacent the upper end of the collar 36 interconnects the three skirts 52, 54 and 56, and a rim 62 rises upwardly from the transverse web 60 about the latter's entire periphery, thereby giving a recessed effect to the top portion of the collar 36. Locking means broadly denoted by the numeral 64 for holding the plunger 40 in its fully depressed position of FIGS. 1 and 2 is in the nature of a bayonet-type lock that includes three circumferentially spaced, radially projecting tangs 66 on the plunger 40 just below the head 42 and three overhanging, circumferentially spaced and radially inwardly projecting shoulders 68 on the rim 62. As illustrated perhaps most clearly in FIG. 2, each adjacent pair of shoulders 68 is separated by a notch 70 that permits the entry and exit of a corresponding tang 66 into the recessed portion of collar 36 below the shoulders 68. A slight rotation of the head 42 when the tangs 66 have entered the notches 70 and are lower than the shoulders 68 results in the tangs 66 becoming blocked beneath the overhanging shoulders 68 so as to releasably lock the plunger 40 in the down position. Twisting the plunger 40 to subsequently realign the tangs 66 with the notches 70 unlocks the locking means 64 and permits the plunger 40 to be raised.

Along its lower annular periphery, the collar 36 is provided with a yieldably resilient clamping element 72 which forcibly engages the top surface of the top wall 24 of closure 12 in opposition to the flange 30. By virtue of the cooperative clamping action between the element 72 and the underlying flange 30, the closure 12 and the pump 10 are firmly secured together to present an assembly threadable onto and off of the neck finish 16. Preferably, the element 72 is integral with the skirt 56 and depends therefrom in a discontinuous annular configuration about its lower periphery, presenting a series of separate, individually deflectable segments 74 separated by slits 76, each of which segments 74 is deflectable generally outwardly and upwardly under forcible engagement with the top wall 24 as illustrated in FIGS. 1 and 3 and on an enlarged basis in FIG. 5. Each segment 74 is located adjacent and radially outboard termination of the skirt 56 as illustrated best in FIG. 5, defines the lowermost projecting extremity of the skirt 56, and also represents the most yieldable portion of the latter.

Preferably, the collar 36 is molded from a suitable plastic material such as a polyolefin. Polypropylene has been found to be quite effective.

ALTERNATIVE EMBODIMENT

Figure 6:
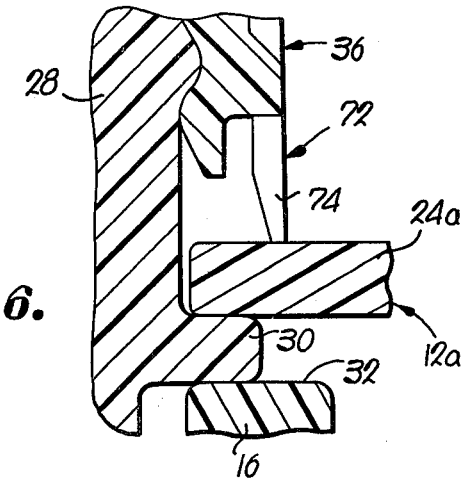
Figure 7:
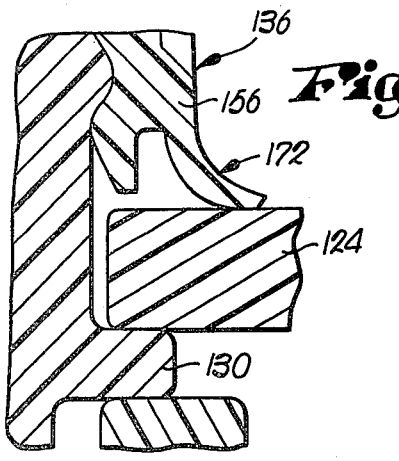
FIGS. 7 and 8 are fragmentary cross-sectional views similar to FIGS. 5 and 6 but showing an alternative embodiment in which the clamping element of the collar is continuously annular.
Figure 8:
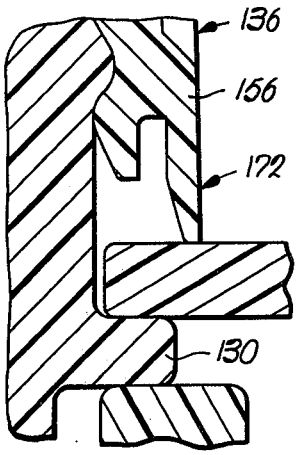
Figure 9:
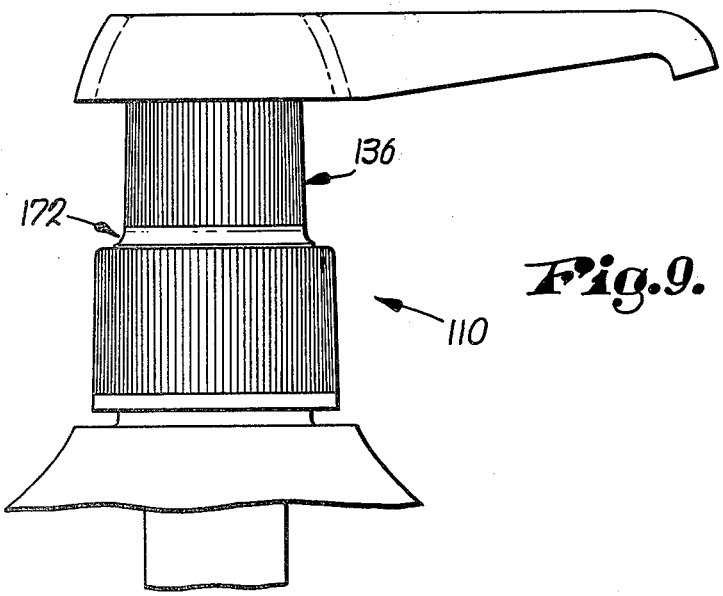
FIG. 9 is a fragmentary elevational view of the alternative embodiment of the pump employing the collar of FIGS. 7 and 8.

FIGS. 7, 8 and 9 relate to a second embodiment of the invention hereinabove described with respect to FIGS. 1–6. In the pump 110, the clamping element 172 of the collar 136, while performing the same functions as the element 72 of pump 10, is constructed in a slightly different way. In this regard, rather than being segmented, the element 172 is of continuous annular configuration about the lower, radially outboard extremity of the skirt 156. The element 172 flexes generally outwardly and upwardly away from the flange 130 when the element 172 is in forcible engagement with the top wall 124 of the closure 136. Collar 136 is constructed from the same material as the collar 36.

OPERATION

Inasmuch as the principles of use and operation of the clamping elements 72 are identical to those of the elements 172, only the use of element 72 will be described hereinafter, it being understood that such comments are equally applicable to the clamping element 172.

As will be noted by comparing FIGS. 5 and 6, the collar 36, when snapped onto the body 28 is always spaced the same predetermined distance from the flange 30, regardless of the thickness of the top wall 24 of the particular closure 12 selected for use. FIG. 6 illustrates the collar 36 used in connection with a closure 12*a* having a relatively thin top wall 24*a* compared to the top wall 24 of closure 12 in FIG. 5. The preferred length of each of the depending segments 74, given the predetermined spacing between the collar 36 and the flange 30, is such that the lowermost terminal end of the respective segments 74 will be maintained in forcible engagement with the thinest top wall 24*a* as shown in FIG. 6 contemplated for use. Although there may be a slight deflection of the segments 74 when used in conjunction with the thin wall 24*a*, it is contemplated that this will be nothing more than that minimum amount which is required to maintain the top wall 24 snugly clamped between the flange 30 on the one hand and the segments 74 on the other hand.

The resiliency and flexibility of the segments 74 is such that, even when the closure 36 is used with the top wall 24 which is of substantially greater thickness than the top wall 24*a*, such increased thickness can be accommodated by virtue of the segments 74 merely flexing upwardly away to a greater extent than that which was required with respect to the top wall 24*a*. Thus, the collar 36 with its segmented clamping element 72 can readily accommodate a wide range of closure thicknesses without sacrificing a firm grip on the closure 12 by the collar 36 and the flange 30.

Furthermore, it is to be noted that all of the flexing and relative movement on behalf of the collar 36 to accommodate the various closure thicknesses is isolated in and limited strictly to the lowermost portion of the collar 36, i.e., the element 72. Thus, there is no distortion or untoward movement of the shoulders 68 of locking means 64 that would tend to misalign those components with respect to the bayonet tangs 66, thereby avoiding any malfunction of the locking means 64 from this source. Likewise, there is no disturbance of the sealing fit achieved between the intermediate skirt 54 of the collar 36 and the upper end of the body 28, thereby minimizing liquid leakage at that location.

We claim:

1. In a manually operated dispensing pump having a tubular body, an annular collar secured to one end of the body in axial registration therewith, and a plunger projecting through said collar and reciprocable within the body, the improvement comprising:

a flange on the exterior of said body spaced below said collar in disposition for abutting the underside of the top wall of a closure having an opening through which the pump may project when installed on the closure; and a clamping element depending integrally from said collar in disposition for bearing against the topside of said top wall of the closure in forcible opposition to said flange when the pump is installed on the closure, said collar being spaced a predetermined distance from said flange and said element being yieldably resilient away from the latter to the extent necessary to accommodate a variety of top wall thicknesses on a corresponding variety of closures while maintaining a clamping force against the same, said collar including a radially inner skirt slidably receiving said plunger, a radially outer skirt having said clamping element at one extremity thereof, and a connecting portion adjacent the opposite extremity of the outer skirt joining the skirts to one another and having structure associated therewith for use in locking the plunger in a fully depressed position, said connecting portion being inflexible relative to said element whereby yielding in the collar to accommodate closure thicknesses occurs in said element rather than said connecting portion and the locking structure.

2. In a pump as claimed in claim 1, wherein said element is of discontinuous annular configuration about a lower periphery of said collar, having a series of discrete, independently yieldable segments.

3. In a pump as claimed in claim 2, wherein each of said segments is deflectable generally outwardly during said yielding away from said flange.

4. In a pump as claimed in claim 1, wherein said element is of continuous annular configuration about a lower periphery of said collar.

5. In a pump as claimed in claim 4, wherein said element is deflectable generally outwardly during said yielding away from said flange.

6. In a pump as claimed in claim 1, wherein said outer skirt has a transverse thickness substantially exceeding that of said element whereby said skirt is substantially less yieldable as a whole than said element.

7. In a pump as claimed in claim 6, wherein said element is located adjacent the radially outer periphery of said outer skirt.

* * * * *